US011585184B1

(12) United States Patent
Fleming et al.

(10) Patent No.: US 11,585,184 B1
(45) **Date of Patent: *Feb. 21, 2023**

(54) METHOD AND APPARATUS FOR POSITIONING OF INJECTOR HEADS AND OTHER INTERVENTION EQUIPMENT

(71) Applicant: PROFESSIONAL RENTAL TOOLS, LLC, Houston, TX (US)

(72) Inventors: Grant Fleming, Lafayette, LA (US); Scott Dees, Lafayette, LA (US)

(73) Assignee: AGI INDUSTRIES, INC., Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/558,785

(22) Filed: Dec. 22, 2021

Related U.S. Application Data

(63) Continuation of application No. 17/410,080, filed on Aug. 24, 2021, now Pat. No. 11,215,023.

(60) Provisional application No. 63/069,877, filed on Aug. 25, 2020.

(51) Int. Cl.
*E21B 33/068* (2006.01)
*E21B 19/22* (2006.01)
*E21B 19/00* (2006.01)

(52) U.S. Cl.
CPC ..... *E21B 33/068* (2013.01); *E21B 19/002* (2013.01); *E21B 19/22* (2013.01)

(58) Field of Classification Search
CPC ..... E21B 33/068; E21B 19/002; E21B 19/22
See application file for complete search history.

(56) References Cited

U.S. PATENT DOCUMENTS

| | | | | |
|---|---|---|---|---|
| 7,861,619 | B2 * | 1/2011 | Stensland | E21B 19/161 81/57.35 |
| 7,921,750 | B2 * | 4/2011 | Pietras | E21B 19/16 81/57.35 |
| 8,408,334 | B1 * | 4/2013 | Orgeron | E21B 19/155 414/22.58 |
| 9,453,377 | B2 * | 9/2016 | Mosing | E21B 19/164 |
| 10,081,991 | B2 * | 9/2018 | Amezaga | E21B 19/161 |
| 10,633,931 | B1 * | 4/2020 | Burns | E21B 7/02 |
| 11,078,735 | B2 * | 8/2021 | Richard | E21B 19/08 |
| 11,215,023 | B1 * | 1/2022 | Fleming | E21B 19/22 |
| 2019/0153793 | A1 * | 5/2019 | Bouligny | E21B 19/06 |

OTHER PUBLICATIONS

Rolls-Royce, 21499 Advanced Tension Frame ATF_010 User Manual, Date (2012), 243 pages.
Osbit, STF680 Tension Frame, Operations & Maintenance Manual, Oct. 12, 2018, 12 pages.
Nov, Compensated Coiled Tubing Lift Frame, Uploaded Aug. 4, 2017, https://www.youtube.com/watch? v=wLIN_7aM4nY, 10 pages.

* cited by examiner

*Primary Examiner* — Yong-Suk (Philip) Ro
(74) *Attorney, Agent, or Firm* — Ted M. Anthony

(57) ABSTRACT

A dual-open entry injector head positioning system installed on support structures, such as conventional lifting frames, utilized over wells on offshore vessels. The injector head positioning system is lighter and more compact than conventional equipment positioning systems, while permitting simultaneous deployment of multiple intervention systems (such as, for example, continuous tubing and wireline) from said lifting frame.

14 Claims, 11 Drawing Sheets

METHOD AND APPARATUS FOR POSITIONING OF INJECTOR HEADS AND OTHER INTERVENTION EQUIPMENT

BACKGROUND OF THE INVENTION

Field of the Invention

The present invention pertains to an equipment positioning assembly used with lifting frames for lifting and/or supporting equipment, especially on floating vessels. More particularly, the present invention pertains to an equipment positioning assembly for lifting and/or supporting an injector head of a continuous tubing system or other intervention equipment. More particularly still, the present invention pertains to a method and apparatus for re-positioning an injector head for continuous tubing systems within a lift frame support structure, while other well intervention equipment (including, but not necessarily limited to, wireline) can be simultaneously rigged up and utilized.

Brief Description of the Prior Art

Conventional lifting frames are commonly used to support well intervention activities and to provide a compensated window to facilitate the installation and use of surface equipment aboard floating vessels such as, for example, semisubmersible drilling rigs, drillships and/or other similar facilities. As one example, lifting frames are commonly used when performing continuous tubing operations from a semisubmersible rig, drill ship or other floating vessel. In such instances, a continuous tubing injector and/or pressure-control equipment are typically positioned within such lifting frame, which is in turn attached to and supported by a rig's traveling block. Such a configuration enables a rig's heave-compensation system to account for and offset vessel motion while such continuous tubing operations or other intervention operations are being performed.

Conventional lifting frames generally comprise an upper horizontal yoke member having a lifting nubbin designed to be gripped and suspended by a rig's traveling block or other lifting system. A pair of substantially parallel vertical members extend from said upper yoke member. Said parallel vertical members cooperate to define an inside width or gap of a lifting frame—that is, said width is the dimension between the inner surfaces of said substantially parallel vertical members. Typically, an injector head for a continuous tubing system can be installed between said parallel vertical members of a lifting frame and suspended in general alignment over a well bore.

Space availability is limited on many drilling rigs, drillships or other floating vessels, while drill floors of different drilling rigs, drillships or other floating vessels frequently have different configurations or layouts. As a result, many conventional lifting frames do not permit the simultaneous deployment of a continuous tubing equipment, as well as other intervention means (including, but not limited to continuous wireline, slickline or electric line units).

Conventional lifting frames typically require such wireline equipment (or other continuous tubing equipment) to be lifted over a well center while avoiding obstructions during such positioning. In such instances, wireline or continuous tubing must be "threaded" through an injector head positioning system. These conventional solutions require additional time to perform, require additional overhead lifting operations, and give rise to numerous safety and operational problems.

Thus, there is a need for a coiled tubing lifting frame and injector head positioning system that permits safer and more efficient intervention operations to be conducted on offshore vessels.

SUMMARY OF THE INVENTION

The present invention comprises an equipment positioning assembly that can be utilized in connection with lifting frames for intervention service operations. The equipment positioning assembly of the present invention retains the functionality and capabilities of a conventional enclosed injector head positioning system, while permitting simultaneous deployment of multiple intervention systems.

In a preferred embodiment, the equipment positioning assembly of the present invention comprises a plurality of side guide members that can be operationally attached to frame legs of a conventional lifting frame, typically using attachment hubs on said lifting frame. Said attachment hubs are utilized to secure the equipment positioning assembly of the present invention vertically within said lifting frame.

An independent track component is operationally attached to each of said side guide members; in a preferred embodiment, two independent track components are disposed in substantially parallel or spaced relationship. A base member is moveably disposed on said parallel track components. A swivel plate member can be disposed on said base member and can serve as an interface for mounting an injector head or other equipment on said base member.

Said equipment positioning assembly of the present invention can be used to support an injector head or other equipment during intervention operations. In a preferred embodiment, the equipment positioning assembly of the present invention allows wireline equipment to be lifted and installed from the front and/or back of the lifting frame while avoiding interference with an injector head positioning system during all lifting and other operations.

Said base member and swivel mounting plate can each have "U slot" design that permits a continuous tubing injector head (or other intervention equipment), as well as any accessory equipment disposed there below, to be installed in said lifting frame without requiring lifting and placement through a conventional equipment support assembly. The present invention permits both wireline and continuous tubing intervention equipment to be deployed simultaneously using a continuous tubing lift frame, while allowing safer and more efficient means of installation. Put another way, the present invention allows continuous tubing and wireline equipment to be moved directly into the injector head positioning system (through said U-slot openings), as opposed to being lifted and suspended above the entire structure and lowered into position, as is required by conventional enclosed injector head positioning systems.

The equipment positioning assembly of the present invention includes openings on the front and back of said equipment positioning system that permits a continuous tubing injector head and wireline equipment installed and removed in a much safer manner than conventional means.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
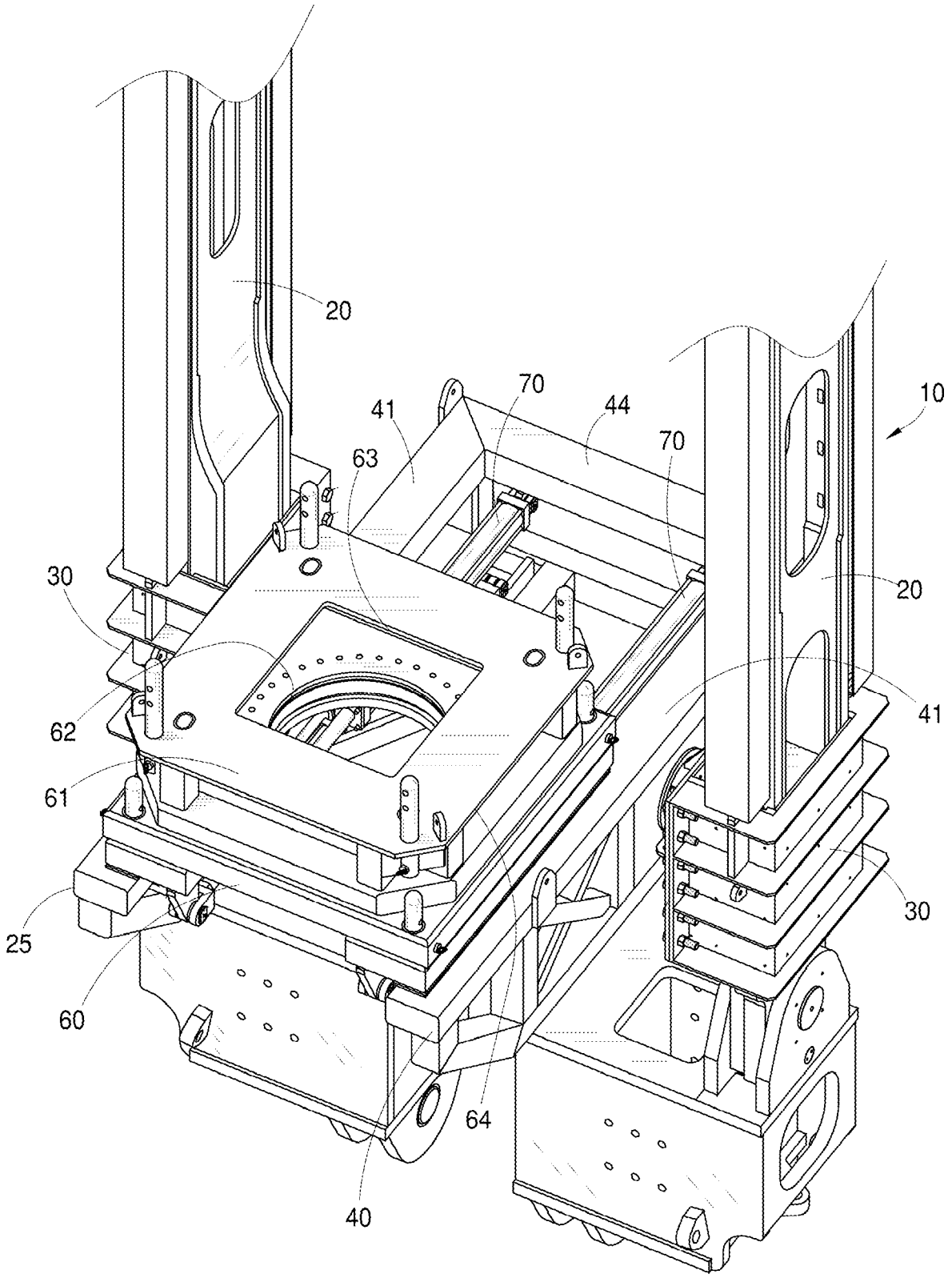
Fig. 1 PRIOR ART
FIG. 1 depicts a side perspective view of a conventional lifting frame having an equipment support assembly.
Figure 1A:
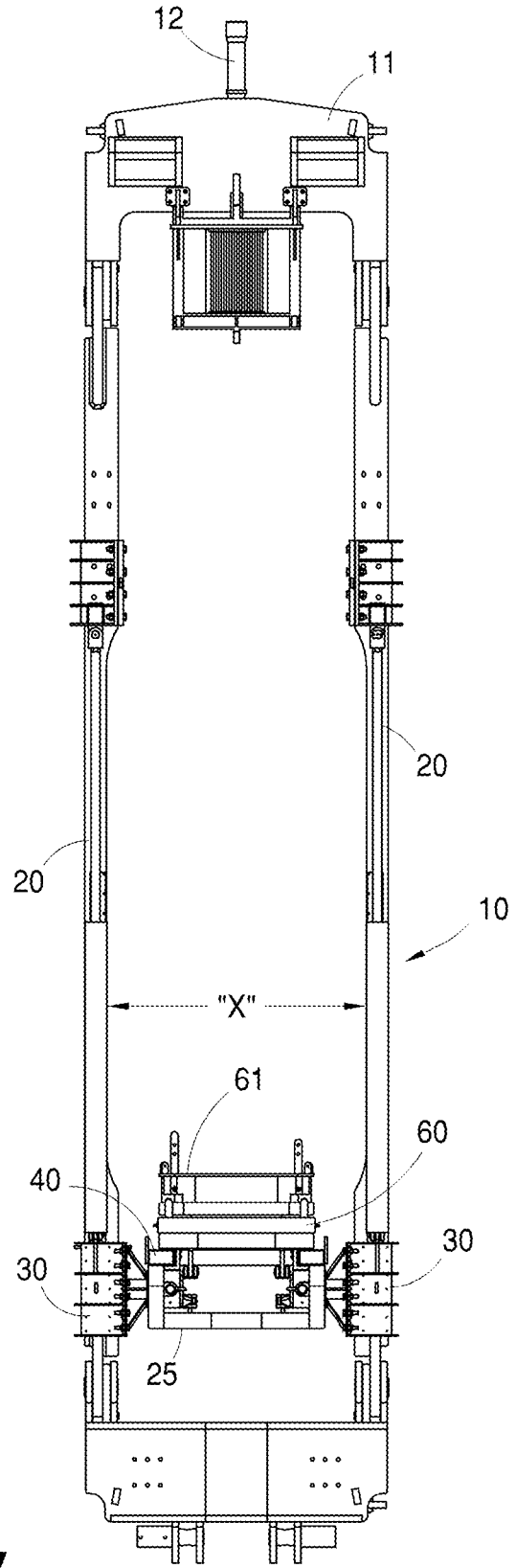
Fig. 1A PRIOR ART
FIG. 1A depicts a front view of a conventional lifting frame having an equipment support assembly.

FIG. 1 depicts a side perspective view of a conventional lifting frame 10 having an equipment support apparatus 25, while FIG. 1A depicts a front view of a conventional lifting frame having an equipment support apparatus 25. Referring to FIG. 1A, conventional lifting frame 10 generally comprise an upper horizontal yoke member 11 having a lifting nubbin 12 configured to be gripped and suspended by a rig's traveling block or other lifting system. A pair of substantially vertical frame members 20 extend from said upper yoke member 11 and are oriented substantially parallel to each other. Said substantially parallel vertical members 20 are generally positioned within the same plane and cooperate to define an inside width or gap of a lifting frame—that is, said width is the dimension between the inner surfaces of said substantially parallel vertical members, depicted as dimension "x" in FIG. 1A.

In some embodiments, an injector head for a continuous tubing system (or other equipment) can be installed directly within said conventional lifting frame 10 by mounting said injector head between said substantially vertical frame members 20. In such cases, the injector head or other equipment can be aligned directly above an underlying well bore; however, the injector head or other equipment must be removed from the lifting frame in order to reposition said injector head or other equipment laterally relative to said well bore.

In other embodiments, said conventional lifting frame 10 can also include an apparatus for horizontally repositioning an injector head or other equipment relative to an underlying well bore while said injector head or other equipment is still suspended from said lifting frame. Referring to FIGS. 1 and 1A, said conventional lifting frame 10 further comprises an equipment support apparatus 25. Said equipment support apparatus 25 generally comprises robust frame base member 40 that is secured to attachment hubs 30 of lifting frame 10. Support table 60 is slidably disposed on upper surfaces 41 of frame base member 40 and is capable of skidding or sliding along said upper surfaces 41.

An injector head for continuous tubing or other equipment (not depicted in FIG. 1) can be mounted on upper surface 61 of support table 60. Referring to FIG. 1, hydraulic cylinders 70 are operationally attached to said frame base member 40 and support table 60. Said hydraulic cylinders 70 can be used to selectively slide said support table (and any equipment disposed thereon) along the length of underlying frame base member 40 in a direction that is generally perpendicular to the plane formed by parallel vertical frame members 20.

Conventional support table 60 defines a multi-sided (typically square or rectangular) member for supporting an injector head of a continuous tubing system or other well intervention equipment. Said support table 60 has a plurality of closed sides, but defines an upper opening 63 to central aperture or opening 62 extending through said support table 60. It is to be observed that any injector head or other equipment that is to be disposed on upper surface 61 of support table 60 must generally be lifted and lowered onto said upper surface 61 of said support table, while any extension or equipment disposed there below must be threaded through said opening 63 and aperture 62. Such lifting and placement is particularly necessary when any lower component or element of said injector head or other equipment must be received within said opening 63 and/or aligned aperture 62 because said closed sides 64 prevent simple lateral placement of the injector head or other equipment on said upper surface 61 without any lifting/lowering operations.

Similarly, conventional frame base member 40 also defines a multi-sided (typically rectangular) member providing a structural base for table member 60 and any injector head or other equipment mounted thereon. Said frame base member 40 has a plurality of closed sides, but defines an upper opening. Frame base member 40 is required to support bending moment, torque and other forces resulting from placement and/or operation of an injector head or other heavy equipment on table 60. Put another way, frame base member 40 provides a structural member linking substantially vertical frame members 20 of lifting frame 10 that is necessary to support an injector head or other heavy equipment.

As previously discussed, support table 60 is slidably disposed on upper surface 41 of frame base member 40, while an injector head for continuous tubing or other equipment can be mounted on upper surface 61 of support table 60. At least one hydraulic cylinder 70 can be used to selectively slide said support table 60 along the length of underlying frame base members 40 and, more specifically, upper surfaces 41 thereof. In many instances, said support table 60 (and any equipment mounted thereon) can be moved laterally out of vertical alignment with an underlying well bore or well center, thereby permitting access to said well bore/well center with wireline unit or other intervention equipment. However, it is to be observed that closed side 44 of frame base member 40 prevents simple lateral placement of wireline or other intervention equipment in vertical alignment with an underlying well bore/well center; said wireline or other intervention equipment typically must be lifted and placed in vertical alignment with an underlying well bore/well center (that is, generally in the space formed between substantially vertical frame members 20) even when table member 60 is slid out of said space between said vertical frame members 20.

Figure 2:
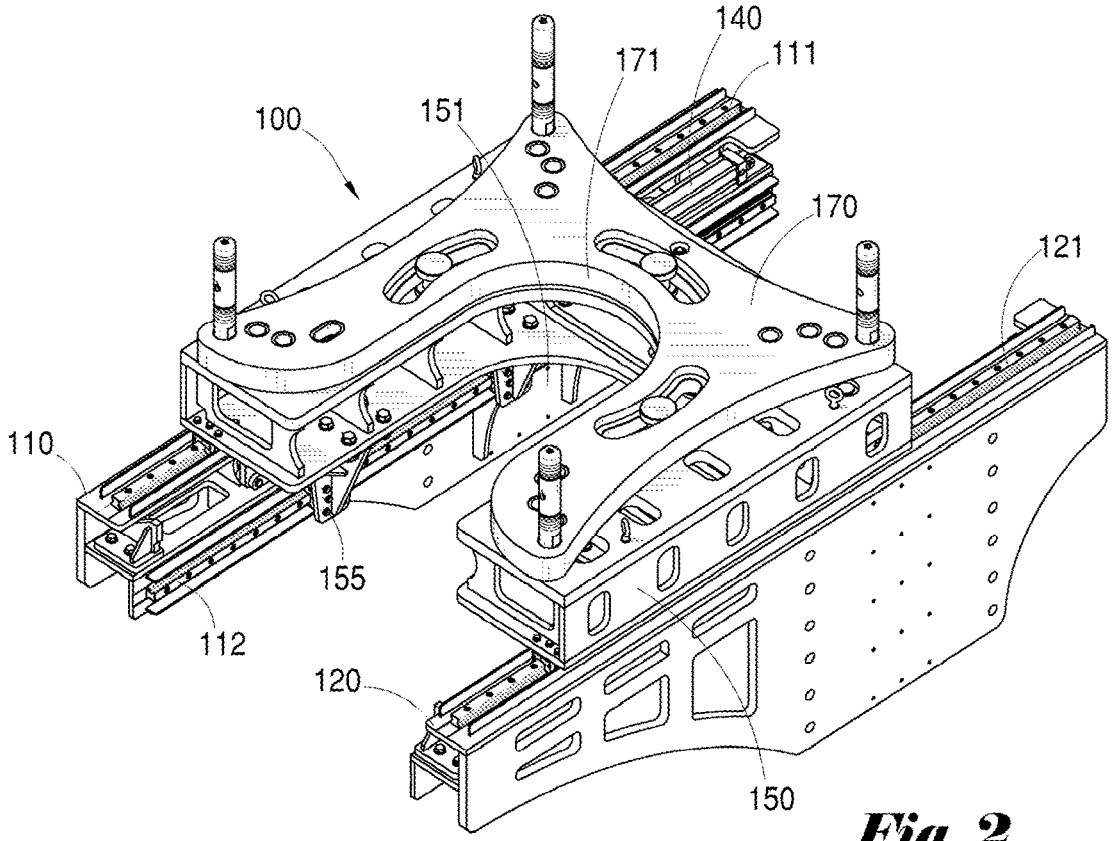
FIG. 2 depicts a side perspective view of an equipment positioning assembly of the present invention.
Figure 3:
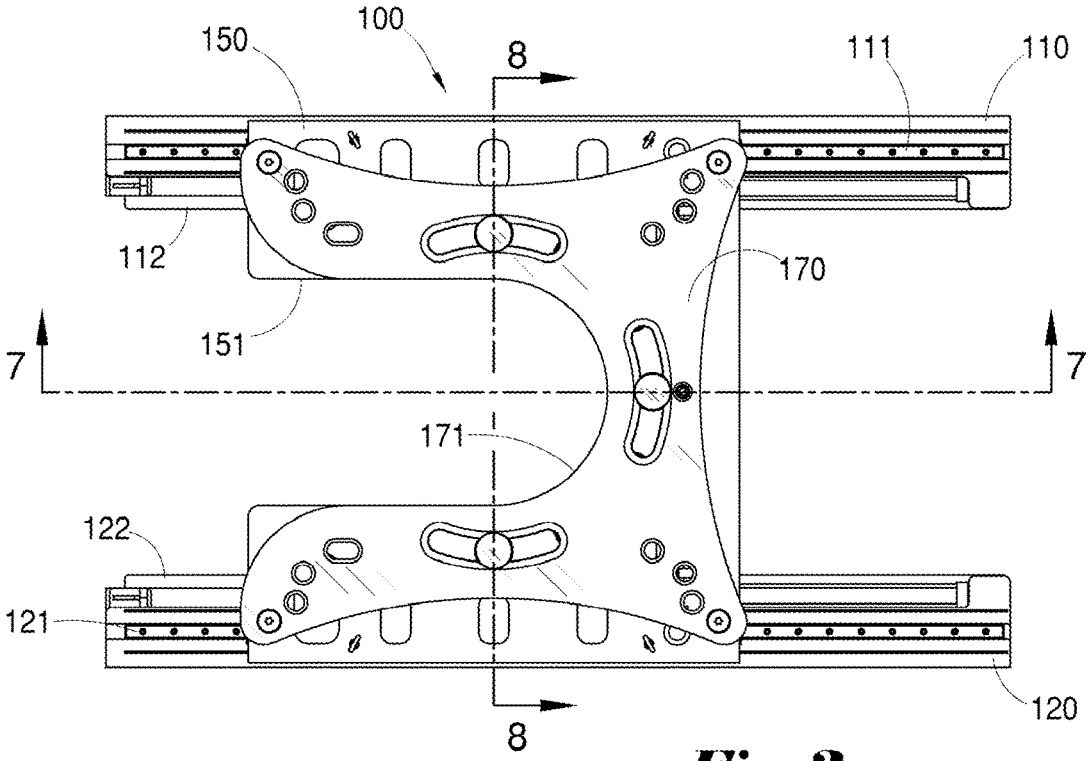
FIG. 3 depicts an overhead view of an equipment positioning assembly of the present invention.

FIG. 2 depicts a side perspective view of equipment positioning assembly 100 of the present invention, while FIG. 3 depicts an overhead view of said equipment positioning assembly 100. In a preferred embodiment, said equipment positioning assembly 100 generally comprises first side guide member 110 and second side guide member 120. Said first side guide member 110 and second side guide member 120 are disposed in substantially parallel orientation relative to each other. Upper track member 111 is disposed on the upper surface of said first guide member 110, while side track member 112 is disposed on the inner side of said first guide member 110.

Base member 150 is moveably disposed on said first side guide member 110 and second side guide member 120 and, more specifically, the track members thereof. Mounting plate 170 is disposed on said base member 150; said mounting plate 170 provides an interface for operational attachment of an injector head of a continuous tubing system or other equipment and, in a preferred embodiment, is capable of swiveling relative to said underlying base member 150. Said base member 150 further comprises an opening or slot 151; in a preferred embodiment, said opening or slot 151 is substantially U-shaped when viewed from above and effectively creates an open throat or pathway for receiving other objects. Similarly, mounting plate 170 further comprises an opening or slot 171; in a preferred embodiment, said opening or slot 171 is substantially U-shaped when viewed from above, is generally aligned with opening or slot 151, and effectively creates an open throat or pathway for receiving other objects.

Figure 4:
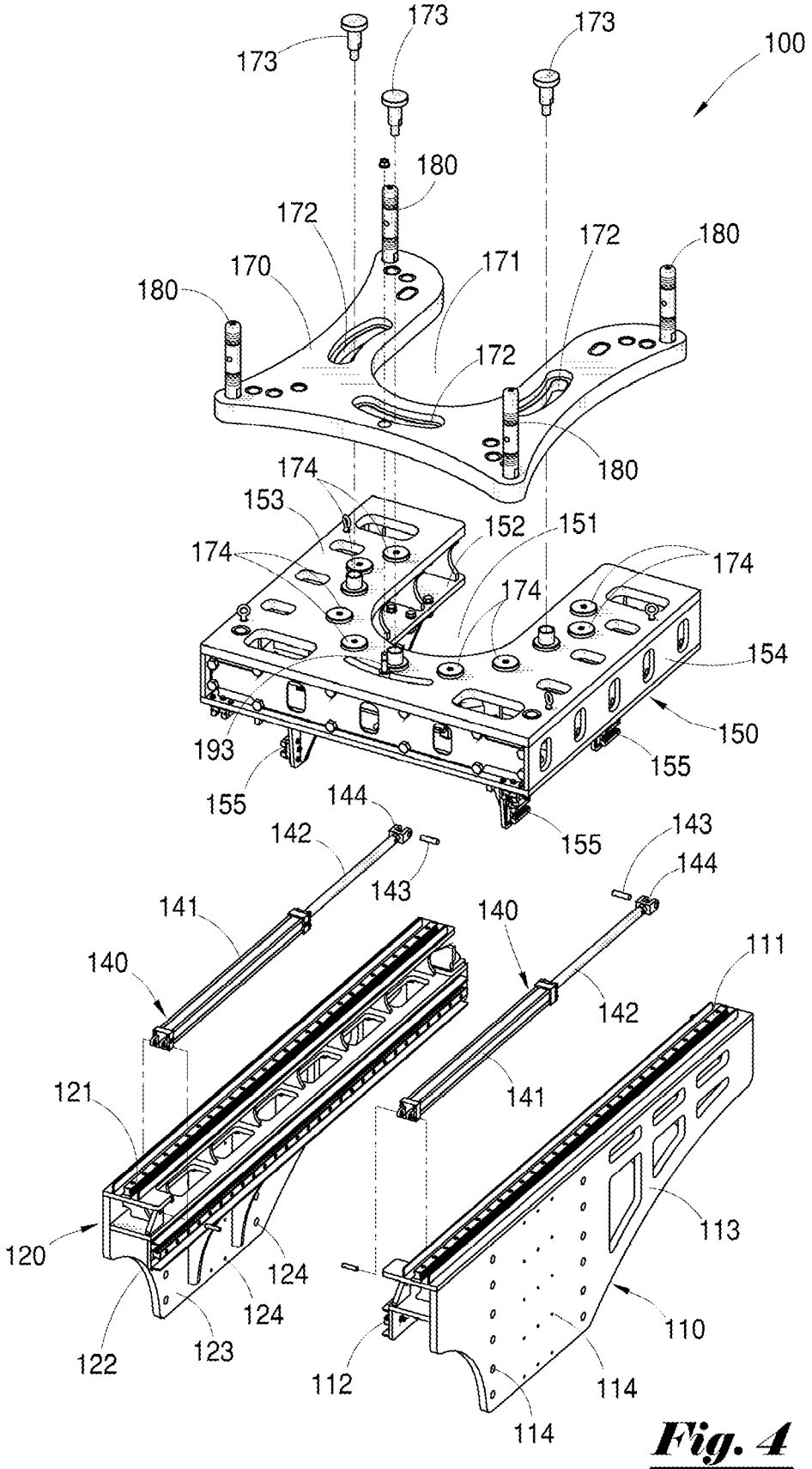
FIG. 4 depicts a rear perspective and exploded view of the equipment positioning assembly of the present invention.

FIG. 4 depicts a rear perspective and exploded view of equipment positioning assembly 100 of the present invention. In a preferred embodiment, said equipment positioning assembly 100 generally comprises first side guide member 110 and second side guide member 120. Said first side guide member 110 has a substantially elongate shape and a side mounting plate 113 defining a plurality of holes or apertures 114; said plurality of holes or apertures 114 can be arranged in a predetermined pattern. Upper track member 111 is disposed on the upper surface of said first side guide member 110. Side track member 112 is disposed on an inner side surface of said first side guide member 110.

Second side guide member 120 is disposed in substantially parallel orientation relative to first side guide member 110. Said second side guide member 120 has a substantially elongate shape and a side mounting plate 123 defining a plurality of holes or apertures 124; said plurality of holes or apertures 124 can be arranged in a predetermined pattern. Upper track member 121 is disposed on the upper surface of said second side guide member 120, while side track member 122 is disposed on an inner side surface of said second side guide member 120.

Base member 150 is moveably disposed on said first side guide member 110 and second side guide member 120 (and, more specifically, track members thereof). In a preferred embodiment, said base member 150 comprises a framework or box-like body section formed by substantially parallel upper plate 153 and lower plate 152, as well as side plates 154, defining an inner space. Track bracket mounting members 155 extend from lower plate 152 and are configured to engage in mating relationship with side track member 112 of first side guide member 110 and side track member 122 of second side guide member 120. Said base member 150 further comprises an opening or slot 151; in a preferred embodiment, said opening or slot 151 forms a U-shaped opening when viewed from above, thereby forming an open throat or pathway for receiving other objects in said opening or slot 151.

Said base member 150 is capable of moving substantially along the lengths of parallel upper track member 111 of said first side guide member 110, and upper track member 121 of said second side guide member 120. Upper tracks 111 and 121, as well as side tracks 112 and 122, reduce frictional forces and guide directional motion of said base member 150 along said tracks.

Linear actuators 140 provide for selective movement of base member 150 along first side guide member 110 and second side guide member 120. Said linear actuators 140 each comprise a fluid powered (typically hydraulic) cylinder having a barrel 141 and piston rod 142; however, it is to be observed that at least one linear actuator 140 can be electrically or pneumatically powered without departing from the scope of the present invention. In a preferred embodiment, at least one linear actuator 140 is operationally attached to first side guide member 110 and base member 150 (using a clevis bracket 144 and pin 143), while a second linear actuator is operationally attached to second side guide member 120 and base member 150 (using a clevis bracket 144 and pin 143). Said linear actuator(s) 140 can be selectively extended or retracted in order to move said base member 150 (and any equipment mounted thereto) along the lengths of upper track 111 of said to first side guide member 110 and upper track 121 of second side guide member 120.

It is to be observed that base member 150 spans the gap or space formed between first side guide member 110 and second side guide member 120. Importantly, said base member 150 comprises a load-bearing member and forms a unifying structural link between said first side guide member 110 and second side guide member 120. Further, said base member 150 must be sufficiently structurally robust to support an injector head of a continuous tubing system or other equipment.

Except for base member 150, a substantially continuous opening or unobstructed pathway is formed between said parallel first side guide member 110 and second side guide member 120. It is also to be observed that removable structural cross supports (or opposing U-slot openings) can be optionally utilized without departing from the scope of the present invention. By way of illustration, but not limitation, at least one structural cross support can be disposed between first side guide member 110 and second side guide member 120. When desired (such as, for example, when moving an injector head or deploying a wireline system) said at least one structural cross member can be selectively removed or repositioned so that it does not obstruct or block a desired open area or pathway formed between said parallel first side guide member 110 and second side guide member 120. Thereafter, said at least one structural support or cross member can be reinstalled or repositioned between said first side guide member 110 and second side guide member 120, such as after an injector head has been repositioned or wireline has been deployed.

Mounting plate 170 is disposed on the upper surface of said base member 150; said mounting plate 170 provides an interface for operational attachment of an injector head of a continuous tubing system or other equipment. In a preferred embodiment, said mounting plate 170 generally comprises a substantially planar member having curved slots 172 extending therethrough. Further, said mounting plate 170 also comprises an opening or slot 171 that is positioned in general alignment with opening/slot 151 of base member 150. In a preferred embodiment, said opening or slot 171 forms a U-shaped opening when viewed from above, thereby forming an open throat or pathway for receiving other objects in said opening or slot 171. A plurality of adjustable stobs 180 is disposed on said mounting plate 170 at desired locations.

Pins 173 are moveably disposed within curved slots 172 and anchored to underlying base member. Mounting plate 170 is capable of swiveling relative to said underlying base member 150 about an axis of rotation oriented substantially perpendicular to said planar mounting plate 170. A plurality of friction-reducing pads 174 can be disposed on the upper plate 153 of body member 150 in order to reduce frictional forces resulting from swivel movement of said mounting plate 170 on said body member 150. Said pads 174 can be constructed of polytetrafluoroethylene (PTFE), ultra high molecular weight polyethylene (UHMW) or other material have desired friction reducing and durability characteristics.

Figure 5:
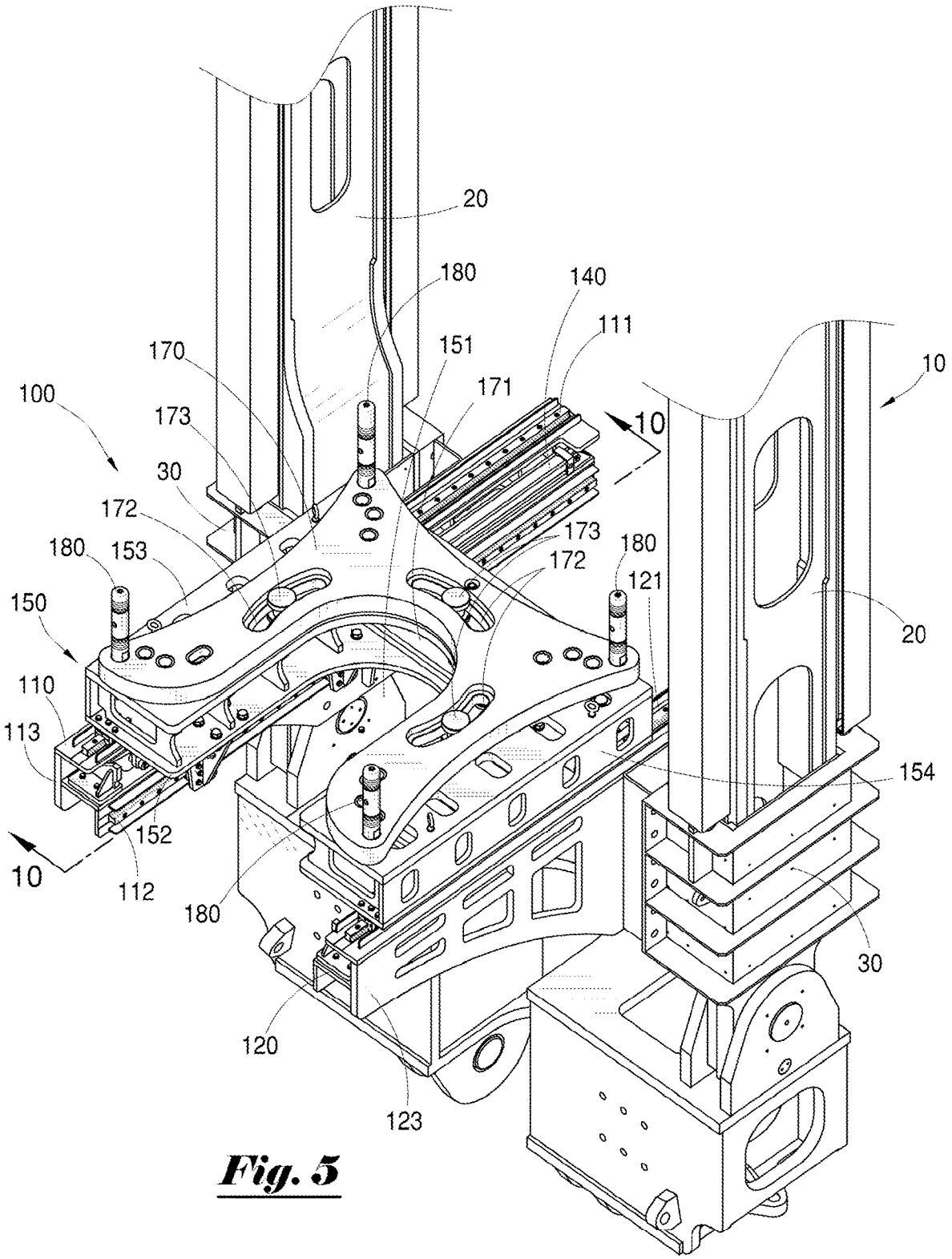
FIG. 5 depicts a side perspective view of the equipment positioning assembly of the present invention installed on a lifting frame.
Figure 6:
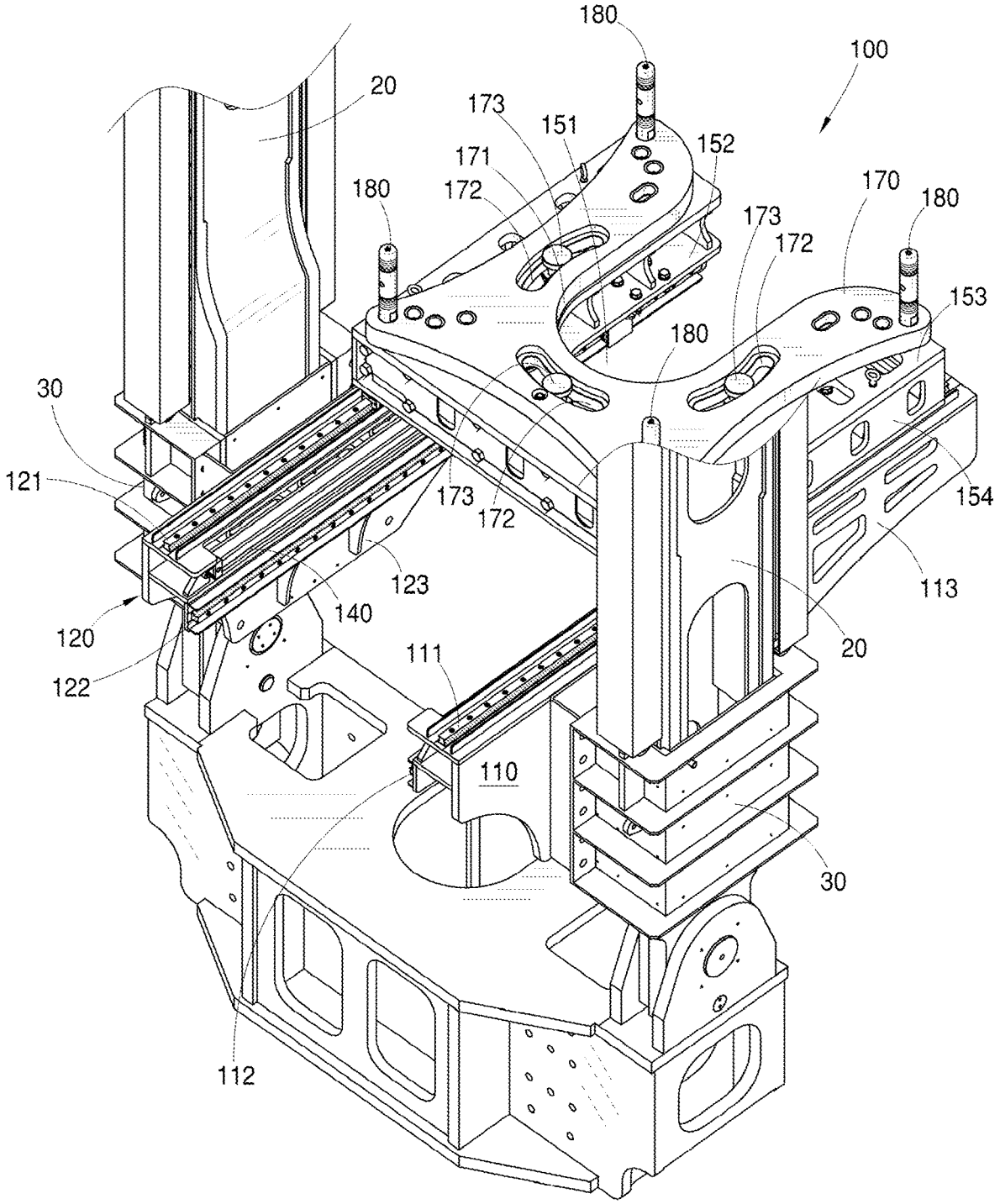
FIG. 6 depicts a rear perspective view of the equipment positioning assembly of the present invention installed on a lifting frame.

FIG. 5 depicts a front perspective view of equipment positioning assembly 100 of the present invention installed on a lifting frame 10, while FIG. 6 depicts a rear perspective view of said equipment positioning assembly 100. Although not visible in FIGS. 5 and 6, lifting frame 10 generally comprises an upper horizontal yoke member having a lifting nubbin designed to be gripped and suspended by a rig's traveling block or other lifting system and well known to those having skill in the art. A pair of substantially vertical frame members 20 are oriented substantially parallel to each other and are disposed within a common plane.

In a preferred embodiment, said equipment positioning assembly 100 generally comprises first side guide member 110 and second side guide member 120. Side mounting plate 113 of said first side guide member 110 is securely attached to one attachment hub 30, while side mounting plate 123 of second side guide member 120 is securely attached to another attachment hub 30. In this manner, first side guide member 110 and second side guide member 120 are disposed laterally along both sides of said equipment positioning assembly 100.

Said first and second side guide members 110 and 120 can be secured to said attachment hubs 30 of lifting frame 10 using mechanical fasteners such as, for example, threaded bolts disposed through patterned apertures disposed through side mounting plates 113 and 123, respectively. Additionally, placement of said attachment hubs 30 (and, as such, first side guide member 110 and second side guide member 120) can be vertically adjusted along the length of substantially parallel vertical members 20.

Upper track member 111 is disposed on the upper surface of said first side guide member 110, while side track member 112 is disposed on an inner side surface of said first side guide member 110. Similarly, upper track member 121 is disposed on the upper surface of said second side guide member 120, while side track member 122 is disposed on an inner side surface of said second side guide member 120.

Base member 150 is moveably disposed on said track members 111 and 112 of first side guide member 110, as well as track members 121 and 122 of second side guide member 120. Said base member 150 comprises a framework or box-like body section formed by substantially parallel upper plate 153 and lower plate 152, as well as side plates 154, defining an inner space. Said base member 150 further comprises an opening or slot 151; said opening or slot 151 forms a U-shaped opening when viewed from above, thereby forming an open throat for receiving other objects in said opening or slot 151.

Said base member 150 is capable of moving substantially along the lengths of parallel upper track member 111 of said first side guide member 110, as well as upper track member 121 of said second side guide member 120. Upper tracks 111 and 121, as well as side tracks 112 and 122, reduce frictional forces and guide directional motion of said base member 150 along said tracks. Base member 150 spans the gap or space formed between first side guide member 110 and second side guide member 120. In a preferred embodiment, said base member 150 is structurally robust and can support an injector head of a continuous tubing system or other equipment.

Still referring to FIGS. 5 and 6, at least one linear actuator 140 facilitates selective movement of base member 150 along first side guide member 110 and second side guide member 120. Said at least one linear actuator(s) 140 can be selectively extended or retracted in order to move said base member 150 (and any equipment mounted thereto) along the corresponding lengths of said to first side guide member 110 and second side guide member 120.

Mounting plate 170 is disposed on the upper surface of said base member 150; said mounting plate 170 provides an interface for operational attachment of an injector head of a continuous tubing system or other equipment. A plurality of curved slots 172 extend therethrough, while an opening or slot 171 is positioned in general alignment with opening/slot 151 of base member 150. In a preferred embodiment, said opening or slot 171 forms a U-shaped opening or pathway when viewed from above, thereby forming an open throat for receiving other objects in said opening or slot 171. Pins 173 are disposed within curved slots 172 and anchored to underlying base member 150. Mounting plate 170 is capable of swiveling relative to said underlying base member 150 about an axis of rotation oriented substantially perpendicular to said planar mounting plate 170. A plurality of adjustable stobs 180 is disposed on mounting plate 170.

Referring to FIGS. 5 and 6, it is to be observed that first side guide member 110 and second side guide member 120 are spaced apart to define an unobstructed or open pathway between said first side guide member 110 and second side guide member 120. Base member 150 comprises a unifying (and load-bearing) structural member disposed between said first side guide member 110 and second side guide member 120. Further, engagement of base member 150 with upper track member 111 and side track member 112 of first side guide member 110, as well as upper track member 121 and side track member 122 second side guide member 120, resist bending moment or torque forces applied to base member 150 (such as, for example, from loading associated with an injector head or other equipment disposed thereon).

Figure 7:
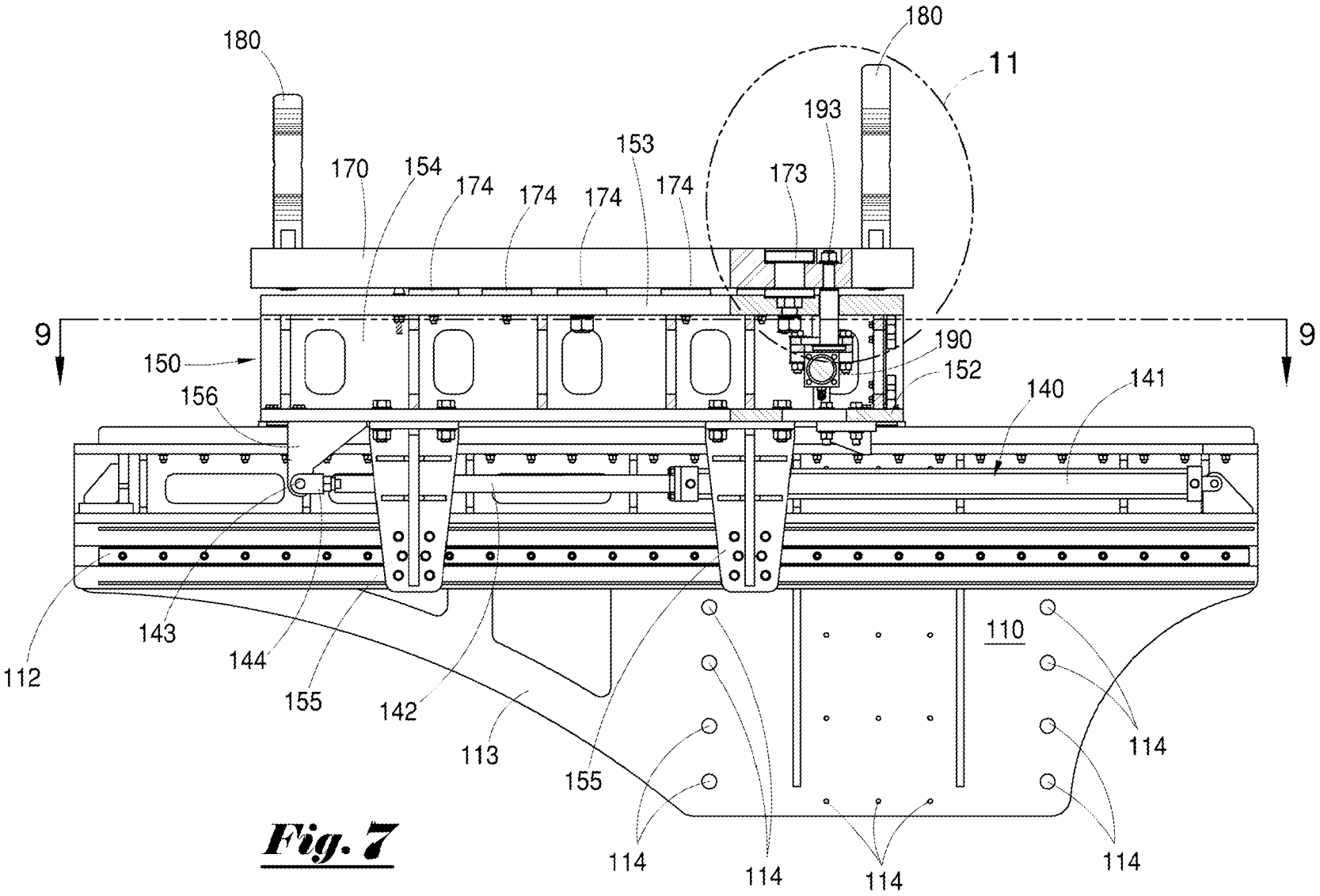
FIG. 7 depicts a first sectional view of the equipment positioning assembly of the present invention along line 7-7 of FIG. 3.

FIG. 7 depicts a first sectional view of the equipment positioning assembly 100 of the present invention along line 7-7 of FIG. 3. First side guide member 110 has a substantially elongate shape and a side mounting plate 113 defining a plurality of holes or apertures 114; said plurality of holes or apertures 114 can be arranged in a predetermined pattern (such as for mating attachment with an attachment hub of a lifting frame). Upper track member 111 is disposed on the upper surface of said first side guide member 110, while side track member 112 is disposed on an inner side surface of said first side guide member 110.

Base member 150 is moveably disposed on said first side guide member 110. In a preferred embodiment, said base member 150 comprises a framework or box-like body section defining an inner space. At least one track mount bracket member 155 extends from lower plate 152 of base member 150 and is configured to engage in mating relationship with side track member 112 of first side guide member 110. Said at least one track mount bracket can have rollers or other frictional reducing mechanism to reduce frictional forces while allowing movement along the longitudinal axis of track member 112. Upper track 111 and side track 112 reduce frictional forces and guide directional motion of said base member 150 along said tracks.

Linear actuator 140 provides for selective movement of base member 150 along first side guide member 110. Said linear actuator 140 comprises a fluid powered (hydraulic) cylinder having a barrel 141 and piston rod 142 that can be selectively extended or retracted. As depicted in FIG. 7, barrel 141 of linear actuator 140 is operationally attached to first side guide member 110, while piston rod 142 is operationally attached to cylinder mount 156 of base member 150 using a clevis bracket 144 and pin 143. Said linear actuator 140 can be selectively extended or retracted in order to move said base member 150 (and any equipment mounted thereto) along the length of upper track 111 of said to first side guide member 110.

Mounting plate 170 is disposed on the upper surface of said base member 150; said mounting plate 170 provides an interface for operational attachment of an injector head of a continuous tubing system or other equipment. A plurality of adjustable stobs 180 is disposed on said mounting plate 170. Pin 173 is moveably disposed within curved slots extending through said mounting plate 170 and anchored to underlying base member 150. Mounting plate 170 can swivel relative to said underlying base member 150 about an axis of rotation oriented substantially perpendicular to said planar mounting plate 170. A plurality of friction-reducing pads 174 are disposed on upper plate 153 of body member 150 in order to reduce frictional forces resulting from swivel movement of said mounting plate 170 on said body member 150.

Figure 8:
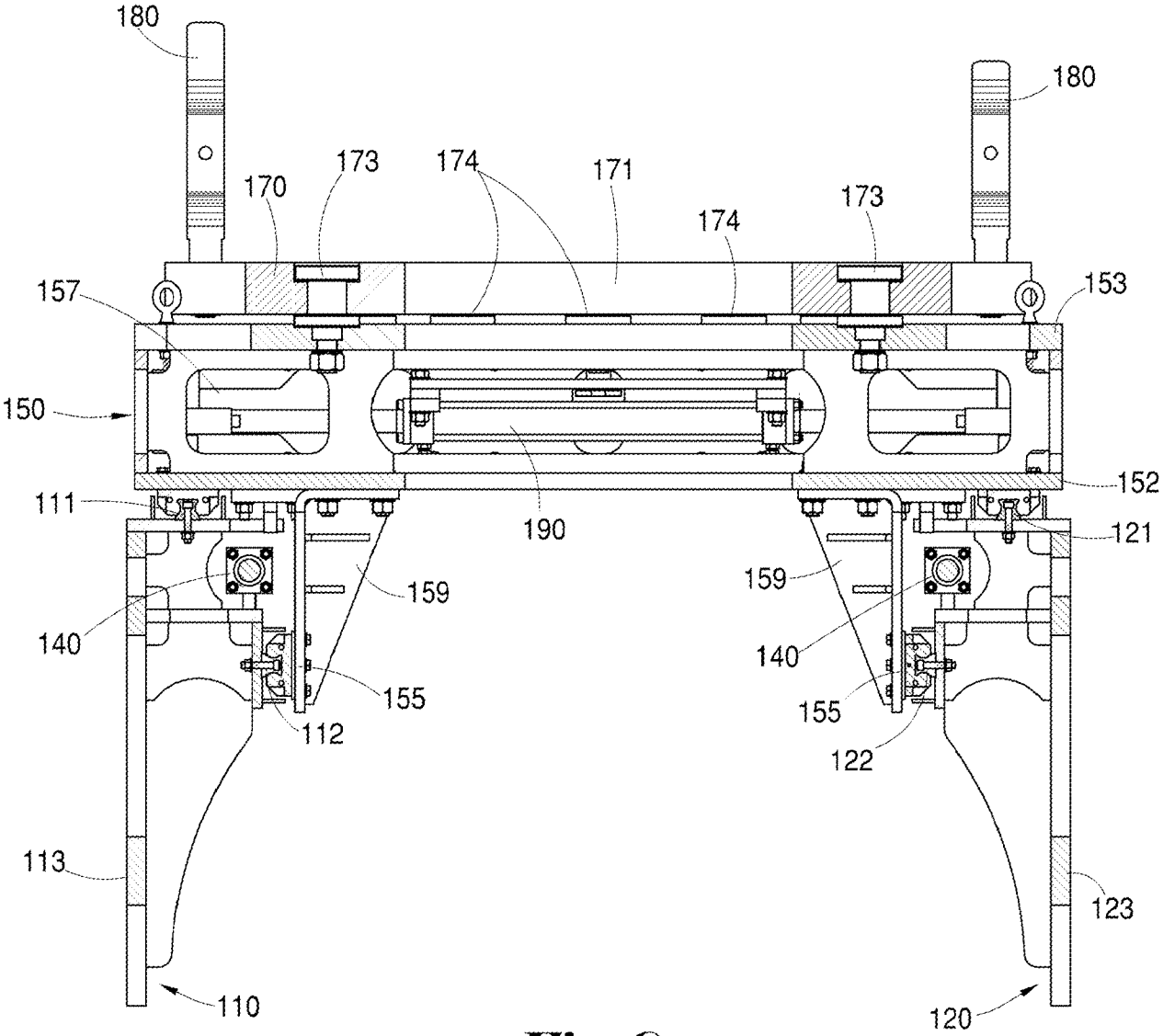
FIG. 8 depicts a second sectional view of the equipment positioning assembly of the present invention along line 8-8 of FIG. 3.

FIG. 8 depicts a second sectional view of equipment positioning assembly 100 of the present invention along line 8-8 of FIG. 3. First side guide member 110 has a substantially elongate shape and a side mounting plate 113 with patterned bolt holes 114 (for mating attachment with an attachment hub of a lifting frame, as depicted in FIGS. 5 and 6). Similarly, second side guide member 120 has a substantially elongate shape and side mounting plate 123 with patterned bolt holes 124 (for mating attachment with an attachment hub of a lifting frame, as depicted in FIGS. 5 and 6). In a preferred embodiment, first side guide member 110 and second side guide member 120 are disposed laterally along both sides of said equipment positioning assembly 100, while side mounting plate 113 and side mounting plate 123 are oriented substantially parallel to each other.

Upper track member 111 is disposed on the upper surface of said first side guide member 110, while side track member 112 is disposed on an inner side surface of said first side guide member 110. Upper track member 121 is disposed on the upper surface of said second side guide member 120, while side track member 122 is disposed on an inner side surface of said second side guide member 120.

Base member 150 is moveably disposed on said first side guide member 110 and second side guide member 120. In a preferred embodiment, said base member 150 comprises a framework or box-like body section defining an inner space 157. Double acting balanced cylinder 190 is disposed within inner space 157. Track mount bracket members 155 extend from lower plate 152 of base member 150 and are configured to engage in mating relationship with side track member 112 of first side guide member 110 and side track member 122 of second side guide member 120. Said track mount brackets 155 can have gusset plates 159 to provide structural support, as well as rollers or other frictional reducing mechanisms to reduce frictional forces while allowing movement along the longitudinal axis of track members 112 and 122. Linear actuators 140 provide for selective movement of base member 150 along first side guide member 110 and second side guide member 120.

Mounting plate 170 is disposed on the upper surface of said base member 150 and provides an interface for operational attachment of an injector head of a continuous tubing system or other equipment. A plurality of adjustable stobs 180 is disposed on said mounting plate 170. Pins 173 are moveably disposed within curved slots extending through said mounting plate 170 and are anchored to underlying base member 150. Mounting plate 170 can swivel relative to said underlying base member 150 about an axis of rotation oriented substantially perpendicular to said planar mounting plate 170.

An opening or slot 171 forms a U-shaped opening when viewed from above, thereby forming an open throat or pathway for receiving other objects in said opening or slot 171. A plurality of friction-reducing pads 174 are disposed on upper plate 153 of body member 150 in order to reduce frictional forces resulting from swivel movement of said mounting plate 170 on said body member 150.

Figure 9:
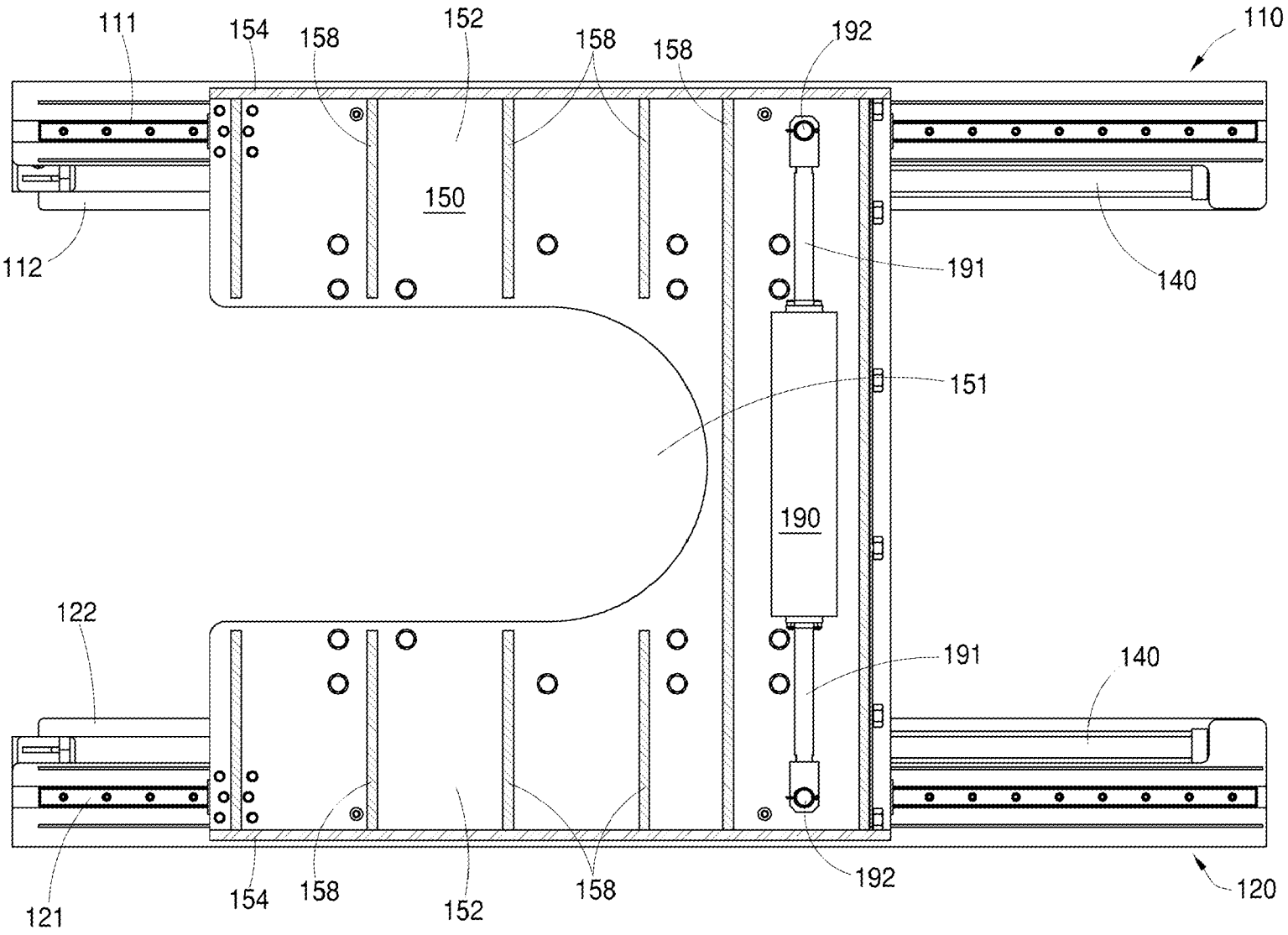
FIG. 9 depicts a third sectional view of the equipment positioning assembly of the present invention along line 9-9 of FIG. 7.

FIG. 9 depicts a third sectional view of the equipment positioning assembly 100 of the present invention along line 9-9 of FIG. 7. In a preferred embodiment, said equipment positioning assembly 100 generally comprises first side guide member 110 and second side guide member 120. Said first side guide member 110 and second side guide member 120 are disposed in substantially parallel orientation relative to each other. Upper track member 111 is disposed on the upper surface of said first guide member 110, while side track member 112 is disposed on the inner side of said first guide member 110. Upper track member 121 is disposed on the upper surface of said second guide member 120, while side track member 122 is disposed on the inner side of said second guide member 120.

Base member 150 is moveably disposed on said first side guide member 110 and second side guide member 120 and, more specifically, the track members thereof. Base member 150 comprises a framework or box-like body section having lower plate 152, as well as side plates 154 and internal structural support plates 158, which can be oriented substantially perpendicular to said side plates 154. Said base member 150 further comprises an opening or slot 151; in a preferred embodiment, said opening or slot 151 is substantially U-shaped when viewed from above and effectively creates an open throat or pathway for receiving other objects. Base member 150 spans the gap or space formed between first side guide member 110 and second side guide member 120.

Linear actuators 140 facilitate selective movement of base member 150 along first side guide member 110 and second side guide member 120. Said linear actuators 140 can be selectively extended or retracted in order to move said base member 150 (and any equipment mounted thereto) along the corresponding lengths of said to first side guide member 110 and second side guide member 120.

Double acting balanced cylinder 190 has selectively extendable/retractable rods 191. The distal ends of said rods 191 are laterally anchored with pivot pins 192. Referring to FIG. 8, mounting pin 193 extends from said double acting balanced cylinder 190 and is operationally connected to mounting plate 170. It is to be observed that selective actuation of double acting balanced cylinder 190 causes mounting plate 170 to swivel relative to said underlying base member 150 about an axis of rotation oriented substantially perpendicular to said planar mounting plate 170.

Figure 10:
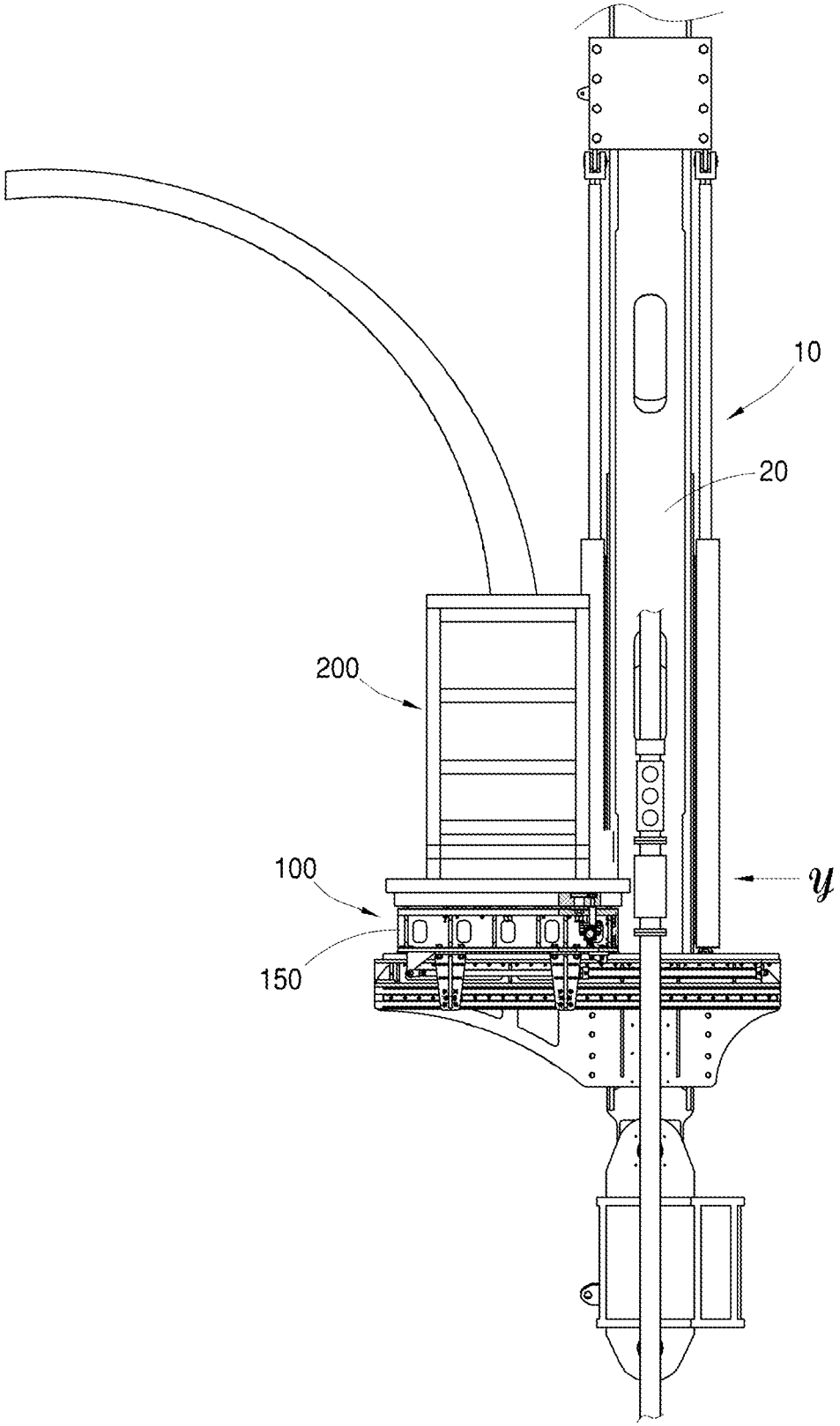
FIG. 10 depicts a side view of the equipment positioning assembly of the present invention installed on a lifting frame and supporting a continuous tubing injector head.

FIG. 10 depicts a side view of the equipment positioning assembly 100 of the present invention installed on a lifting frame 10 and supporting an injector head 200 for a continuous tubing system. In a preferred embodiment, the present invention comprises an equipment positioning assembly 100 having openings or unobstructed pathways on the front and back sides of conventional lifting frames. As such, equipment positioning assembly 100 of the present invention allows both wireline and continuous tubing equipment to be simultaneously deployed by a continuous tubing lift frame, providing for increased safety and efficiency compared to conventional means.

In a preferred embodiment, equipment positioning assembly 100 of the present invention can be used to selectively maneuver a base member (and any injector head or other equipment mounted thereon) horizontally by moving said base member 150 to the "front" and/or the "back" on the positioning assembly—that is, out of alignment with the common plane defined by parallel vertical members of a lifting frame, as well as any underlying well bore or well center. Said base member 150 can have a "U slot" design that defines an opening or pathway to allow a continuous tubing injector head and accessory equipment installed below said injector head to be installed into the positioning system without having to lift said equipment above a support frame and lower or thread it through a standard unslotted or close-sided table (such as, for example, support table 60 depicted in FIG. 1) for installation. Additionally, equipment positioning assembly 100 of the present invention permits wireline equipment to be lifted and installed directly along an opening or pathway from the "back" side of the continuous tubing lifting frame while not being obstructed by the injector head positioning system.

Still referring to FIG. 10, vertical frame member 20 of lifting frame 10 can be positioned in general alignment over an underlying well bore or well center. In a preferred embodiment, the present invention allows continuous tubing injector head 200 or other equipment to be moved directly on to base member 150 of equipment positioning assembly 100 (through said U-slot openings 151 and 171), as opposed to being lifted and suspended above the entire structure and lowered into position, as is required by conventional enclosed injector head positioning systems. Equipment positioning assembly 100 further allows for selective horizontal repositioning of injector head 200 or other equipment relative to an underlying well bore while said injector head 200 or other equipment is still suspended from said lifting frame 10.

Still referring to FIG. 10, injector head assembly 200 can be selectively moved horizontally out of alignment with vertical frame members 20 of lifting frame 10 (and any aligned underlying wellbore) on base member 150. In this configuration, wireline or other intervention equipment can be simultaneously installed and operated within said lifting frame 10. Unlike conventional solutions, equipment positioning assembly 100 of the present invention comprises an open or unobstructed pathway (between first side guide member 110 and second side guide member 120) along the "rear" or back side of said lifting frame 10, generally reflected as direction "y" on FIG. 10. As such, said wireline or other intervention equipment can be moved directly within lifting frame 10 (and, more specifically, the common plane formed between vertical frame members 20) from the direction depicted as direction "y" in FIG. 10, as opposed to being lifted and suspended above the entire structure and lowered into position as required by conventional enclosed injector head positioning systems.

Figure 11:
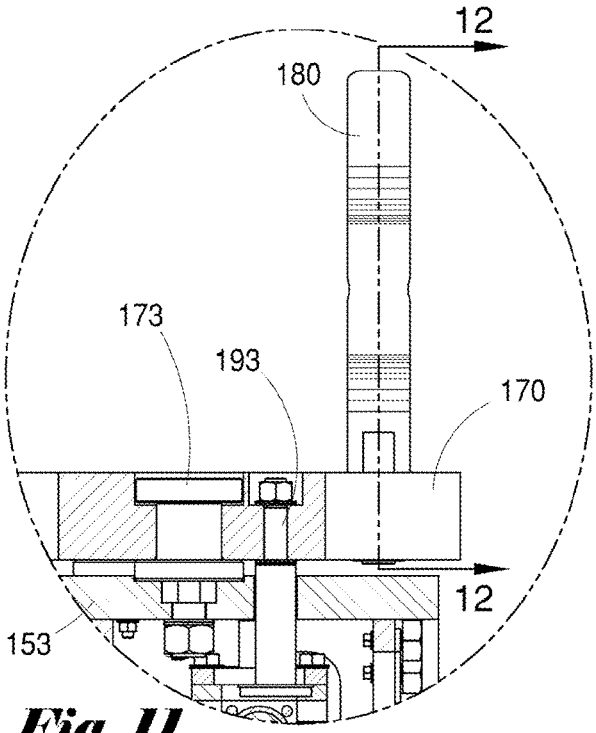
FIG. 11 depicts a detailed view of the highlighted area depicted in FIG. 7.
Figure 12:
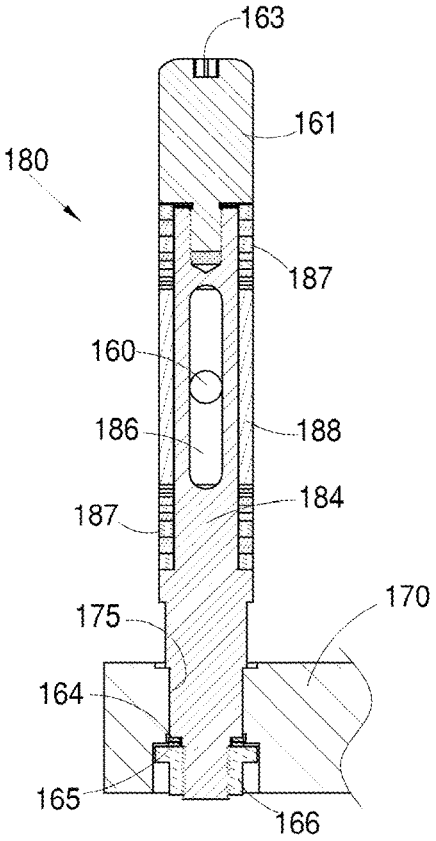
FIG. 12 depicts a side sectional view along line 12-12 depicted in FIG. 11.

FIG. 11 depicts a detailed view of the highlighted area depicted in FIG. 7, while FIG. 12 depicts a side sectional view along line 12-12 depicted in FIG. 11. As previously noted, a plurality of adjustable stobs 180 is disposed on said mounting plate 170 at desired locations. Said stobs 180 are generally disposed in spaced relationship along the upper surface of said mounting plate 170 (typically at corners thereof) and provide anchor points for attachment of injector heads or other equipment on said mounting plate 170.

Figure 13:
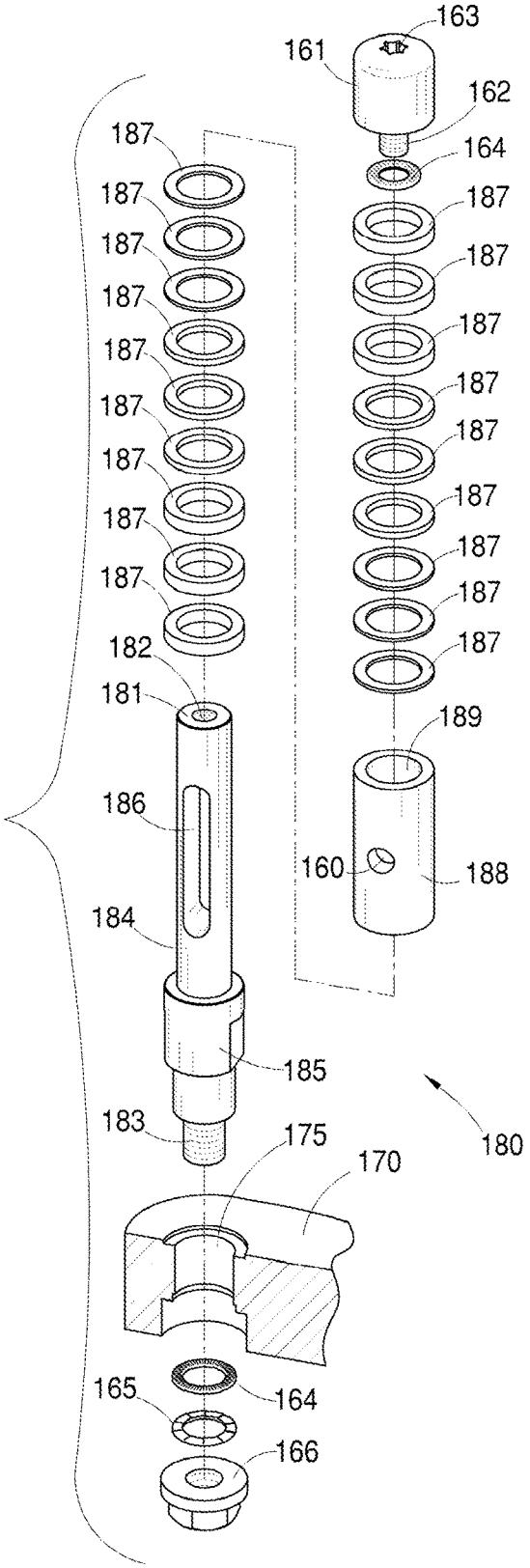
FIG. 13 depicts a perspective and exploded view of an adjustable stob member of the present invention.

FIG. 13 depicts a perspective and exploded view of an adjustable stob member 180 of the present invention. Adjustable stob 180 generally comprises stob post member 181 having body section 184, base 185 and lower threads 183. Upper bore 182 having internal threads is disposed at the (upper) opposite end of said stob post member 181 from lower threads 183. Elongate transverse aperture 186 extends through said body section 184; in a preferred embodiment, said elongated transverse aperture 186 is oriented substantially parallel to the longitudinal axis of body section 184.

Adjustable stob 180 further comprises a plurality of spacer washers 187 sized to be received over the outer surface of body section 184 of stob post member 181, as well as sleeve member 188 having central through bore 189; said central through bore 189 is also sized to be received over the outer surface of body section 184. Transverse bore 160 extends through said sleeve member 188. Cap member 161 has threads 162 configured to mate with threads on the inner surface of upper bore 182 of stob post member 181, as well as shaped recess 163 for receiving a wrench or key for applying torque force to said cap member 161.

Referring back to FIG. 12, stob post member 181 is received within bore 175 extending through mounting plate 170. Said stob post member 181 is secured in place within said bore 175 using washer 164, lock washer 165 and threaded nut 166, which is threadably engaged with threads 183 of stob post member 181. A first plurality of spacer washers 187 is received over the outer surface of body section 184 of stob post member 181. Sleeve member 188 is also received over the outer surface of body section 184 of stob post member 181, followed by a second plurality of spacer washers 187. Cap member 161 is installed on the upper surface of stob post member 181.

In operation, it is to be observed that adjustable stob member 180 allows for selective positioning of transverse bore 160 of sleeve 188 along the longitudinal axis of stob post member 181. Put another way, by selectively arranging the number and placement of first and second spacer washers 187 above and below said sleeve 188, including distribution of spacer washer 187 having desired thickness, a user can selectively position sleeve 188 (and transverse bore 160) along the length of elongated aperture 186. As such, transverse bore 160 can be selectively repositioned along the length of stob member 180 without specialized tools or equipment, and can be quickly and efficiently adjusted to accommodate different injector heads or other equipment to be mounted on the upper surface of mounting plate 170, including the field or other remote location.

The present invention permits use of the full length of a lifting frame work window. As such, longer bottom hole assemblies ("BHA") and/or pressure control assemblies can be deployed as a single lift with the present invention; by contrast, conventional equipment support devices require long assemblies (such as, for example, BHA's and/or pressure control assemblies) to be lifted in multiple pieces due to the height restriction inside the lifting frame and configuration of said support devices.

The present invention also makes running wireline more efficient and user friendly. With the present invention, wireline has a clear and unobstructed path to travel from a lower sheave to an upper sheave before entering a well. By contrast, with conventional equipment support devices, a lower wireline sheave must be strategically placed to ensure the wire does not contact structural member(s) on the front or back of said conventional equipment support device.

Dimensions and material selections disclosed herein are illustrative only and are not intended to be, and should not be construed as, limiting in any way.

The present invention incorporates openings or pathways on the front and back sides of a plane formed by parallel vertical frame members of a conventional lifting frame that allows for a continuous tubing injector head and wireline equipment to be lifted in a safer manner. The present invention allows continuous tubing and wireline equipment to be lifted directly into the equipment positioning assembly through the front and back openings of the structure, as opposed to picking it up above the entire structure and lowering into position which is normal operating procedure for a conventional enclosed injector head positioning system.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A support apparatus for selectively positioning equipment supported by a lifting frame having first and second vertical frame members comprising:

a) at least one horizontal support member operationally attached to said first and second vertical frame members, wherein said at least one horizontal support member defines an upper surface, and wherein said upper surface is oriented perpendicular to the longitudinal axes of said first and second vertical support members;

b) a base member moveably disposed on said upper surface of said at least one horizontal support member, wherein said base member has an opening extending therethrough, and wherein said opening comprises a U-shaped slot when viewed from above; and c) a mounting plate disposed on said base member, wherein said mounting plate has an opening extending therethrough and said opening is aligned with said opening in said base member, said mounting plate can swivel about an axis that is oriented substantially perpendicular to said mounting plate.

2. The support apparatus of claim 1, wherein said opening of said mounting plate comprises a U-shaped slot when viewed from above.

3. The support apparatus of claim 1, further comprising a fluid-powered cylinder and a linkage assembly for selectively swiveling said plate relative to said base member.

4. The support apparatus of claim 3, wherein said fluid-powered cylinder comprises a hydraulic cylinder or a pneumatic cylinder.

5. The support apparatus of claim 1, wherein said at least one horizontal support member further comprises:

a) a first track member; and b) a second track disposed in parallel orientation to said first track member.

6. A support apparatus for selectively positioning a coiled tubing injector head supported by a lifting frame having first and second elongated frame members comprising:

a) a first side guide member operationally attached to said first elongated frame member of said lifting frame, wherein said first side guide member is oriented perpendicular to the longitudinal axis of said first elongated frame member;

b) a second elongated side guide member operationally attached to said second elongated frame member of said lifting frame, wherein said second elongated side guide member is oriented substantially perpendicular to the longitudinal axis of said second elongated frame member of said lifting frame and substantially parallel to said first elongated side guide member, c) a base member moveably disposed on said first elongated side guide member and said second elongated side guide member, wherein said base member has an opening extending therethrough, and wherein said opening comprises a U-shaped slot when viewed from above; and d) a mounting plate disposed on said base member, wherein said mounting plate has an opening extending therethrough and said opening is aligned with said opening in said base member, said mounting plate can swivel about an axis that is oriented substantially perpendicular to said mounting plate.

7. The support apparatus of claim 6, wherein said opening of said mounting plate comprises a U-shaped slot when viewed from above.

8. The support apparatus of claim 6, further comprising a fluid-powered cylinder and a linkage assembly for selectively swiveling said plate relative to said base member.

9. The support apparatus of claim 3, wherein said fluid-powered cylinder comprises a hydraulic cylinder or a pneumatic cylinder.

10. The support apparatus of claim 6, further comprising:

a) a first track member disposed on said first elongated side guide member; and b) a second track member disposed on said second elongated side guide member, in parallel orientation to said first track member.

11. A method for conducting operations using a lifting frame, having first and second elongated frame members, over a well comprising:

a) providing an equipment support apparatus comprising:

i) at least one horizontal support member operationally attached to said first and second elongated frame members, wherein said at least one horizontal support member defines an upper surface, and wherein said upper surface is oriented perpendicular to the longitudinal axes of said first and second elongated frame members;

ii) a base member moveably disposed on said upper surface of said at least one horizontal support member, wherein said base member has an opening extending therethrough, and wherein said opening comprises a U-shaped slot when viewed from above; and iii) a mounting plate disposed on said base member, wherein said mounting plate has an opening extending therethrough and said opening is aligned with said opening in said base member, said mounting plate can swivel about an axis that is oriented substantially perpendicular to said mounting plate;

b) providing a coiled tubing injector head on said base member; and c) moving said base member and coiled tubing injector head along said horizontal support member so that said injector head is out of vertical alignment with said well.

12. The method of claim 11, wherein said opening of said mounting plate comprises a U-shaped slot when viewed from above.

13. The method of claim 11, further comprising a fluid-powered cylinder and a linkage assembly for selectively swiveling said plate relative to said base member.

14. The method of claim 11, further comprising:

a) a first track member disposed on said at least one horizontal support member; and b) a second track member disposed on said at least one horizontal support member, wherein said second track member is oriented in parallel orientation to said first track member.

* * * * *